US008427373B2

(12) United States Patent
Jiang et al.

(10) Patent No.: US 8,427,373 B2
(45) Date of Patent: Apr. 23, 2013

(54) RFID PATCH ANTENNA WITH COPLANAR REFERENCE GROUND AND FLOATING GROUNDS

(75) Inventors: Bing Jiang, San Diego, CA (US); Richard John Campero, San Clemente, CA (US); Steve Edward Trivelpiece, Irvine, CA (US)

(73) Assignee: Sensormatic Electronics, LLC., Boca Raton, FL (US)

( * ) Notice: Subject to any disclaimer, the term of this patent is extended or adjusted under 35 U.S.C. 154(b) by 653 days.

(21) Appl. No.: 12/247,994

(22) Filed: Oct. 8, 2008

(65) Prior Publication Data

US 2009/0213012 A1 Aug. 27, 2009

Related U.S. Application Data

(60) Provisional application No. 60/978,389, filed on Oct. 8, 2007.

(51) Int. Cl.
*H01Q 1/38* (2006.01)

(52) U.S. Cl.
USPC ..... 343/700 MS; 343/846

(58) Field of Classification Search ..... 343/700 MS, 343/846
See application file for complete search history.

(56) References Cited

U.S. PATENT DOCUMENTS

| | | | | |
|---|---|---|---|---|
| 5,021,799 | A * | 6/1991 | Kobus et al. | 343/795 |
| 6,259,408 | B1 | 7/2001 | Brady et al. | |
| 7,737,908 | B2 * | 6/2010 | Yanagi et al. | 343/846 |
| 2002/0175865 | A1 | 11/2002 | Cassel et al. | |
| 2003/0210187 | A1 | 11/2003 | Wong et al. | |
| 2004/0233110 | A1 | 11/2004 | Hung et al. | |
| 2006/0033666 | A1 | 2/2006 | Su et al. | |
| 2006/0097925 | A1 * | 5/2006 | Lee | 343/700 MS |
| 2006/0152364 | A1 | 7/2006 | Walton | |
| 2008/0030422 | A1 | 2/2008 | Gevargiz et al. | |
| 2010/0019038 | A1 * | 1/2010 | Puente Baliarda et al. | 235/439 |
| 2010/0220017 | A1 * | 9/2010 | Ollikainen et al. | 343/702 |

FOREIGN PATENT DOCUMENTS

| | | |
|---|---|---|
| JP | 63-171004 | 7/1988 |
| JP | 10-135726 | 5/1998 |
| JP | 10135726 A * | 5/1998 |
| JP | 2004-328693 | 11/2004 |
| JP | 2005-286997 | 10/2005 |
| JP | 2006-279451 | 10/2006 |
| WO | WO 95/03640 | 2/1995 |
| WO | WO 01/37372 | 5/2001 |

OTHER PUBLICATIONS

Coulibaly, Y., et al., "A New Single Layer Broadband CPW Fed-Printed Monopole Antenna for Wireless Applications", IEEE, 2004, pp. 1541-1544.

International Search Report issued Jan. 22, 2009 in corresponding PCT/US08/079247.

International Search Report issued Sep. 14, 2009 in corresponding PCT/US09/046657.

* cited by examiner

*Primary Examiner* — Hoang V Nguyen
*Assistant Examiner* — Kyana R McCain
(74) *Attorney, Agent, or Firm* — Rick Comoglio

(57) ABSTRACT

In accordance with a preferred embodiment of the invention, reader antennas are provided within storage fixtures for transporting RF signals between, for example, an RFID reader and an RFID tag. In a preferred embodiment, the RFID-enabled storage fixtures are implemented using an intelligent network, which may allow enhanced flexibility in controlling systems for interrogation of RFID antennas.

25 Claims, 11 Drawing Sheets

Patch antenna with coplanar reference ground, as described in the current invention.

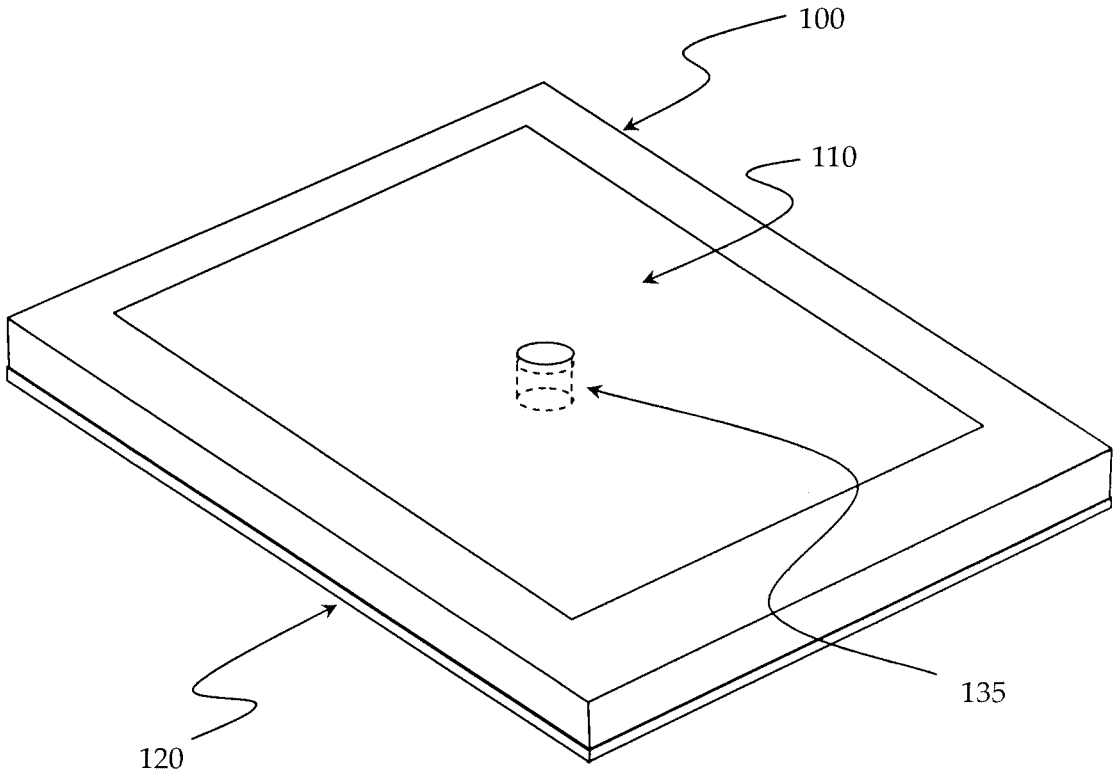
FIG. 1 Patch antenna typical of the prior art.

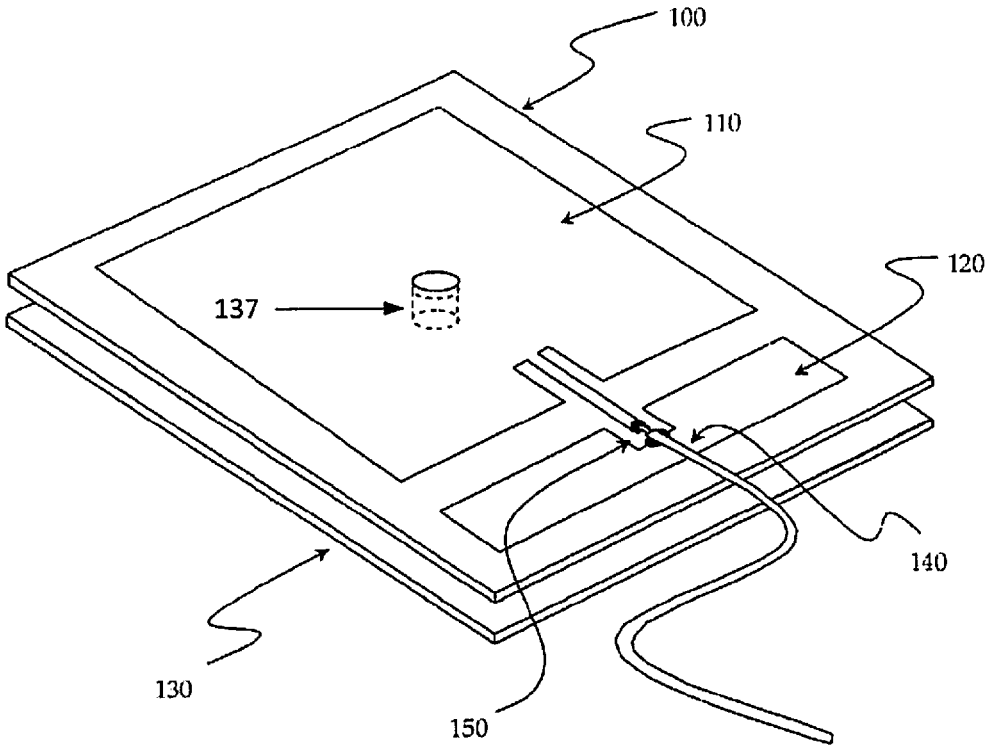
FIG. 2 Patch antenna with coplanar reference ground, as described in the current invention.

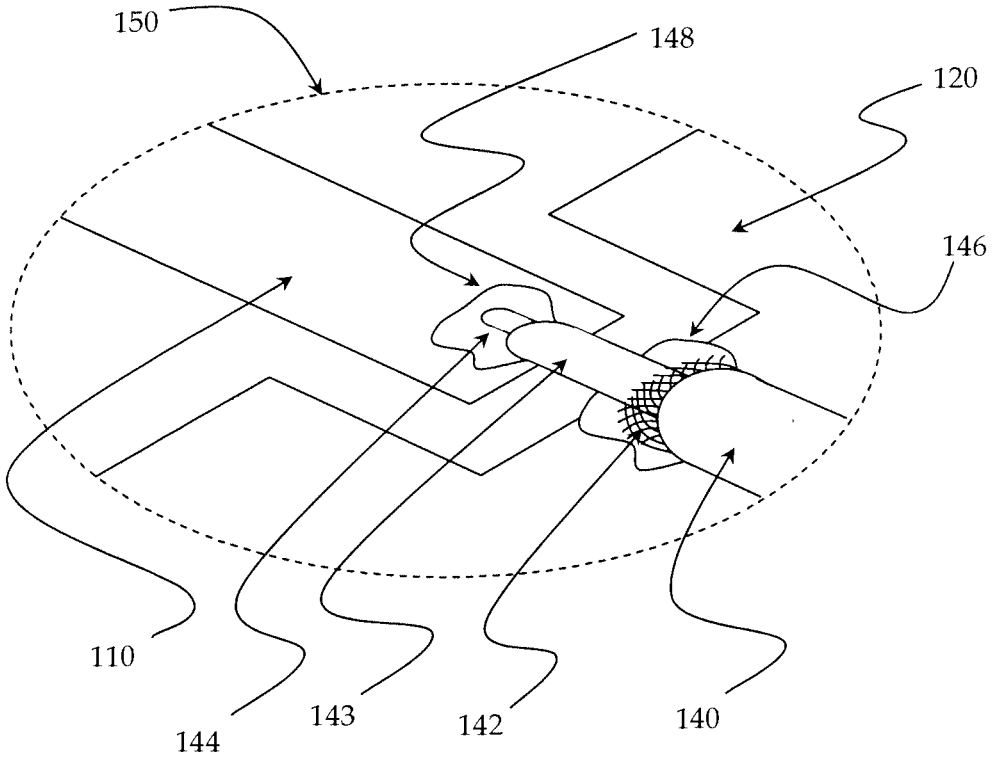
FIG. 3 Detail drawing of the coaxial cable connection to the antenna patch and reference ground planes, as described in the current invention.

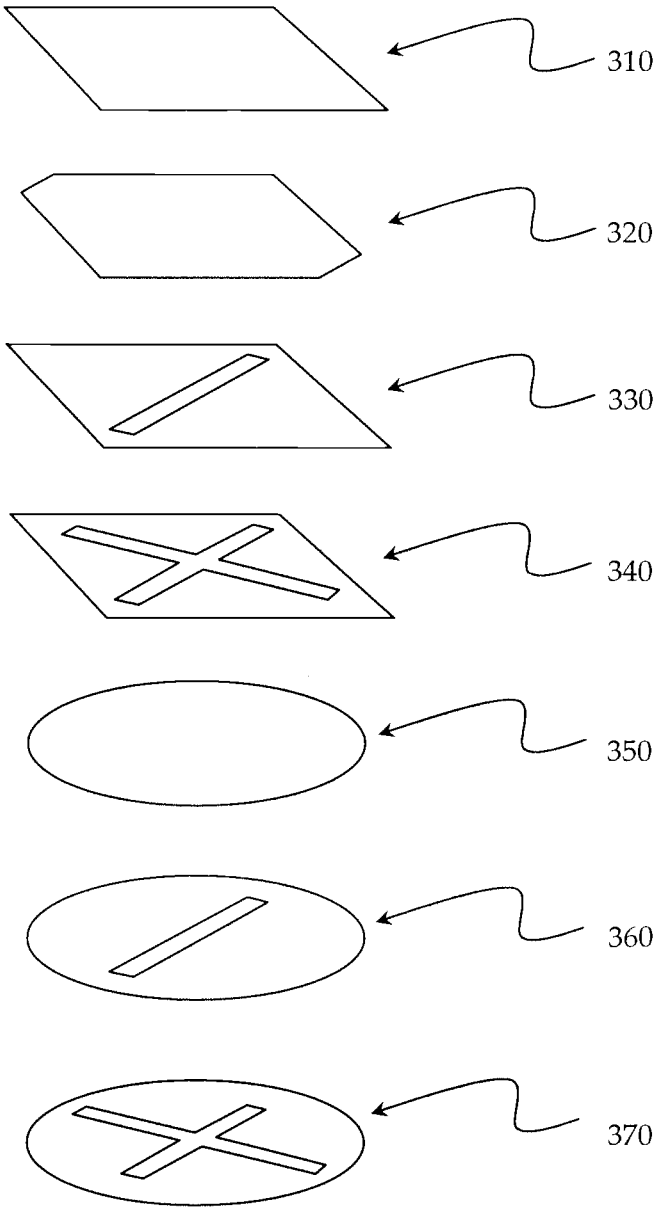
FIG. 4 Examples of alternative patch antenna shapes.

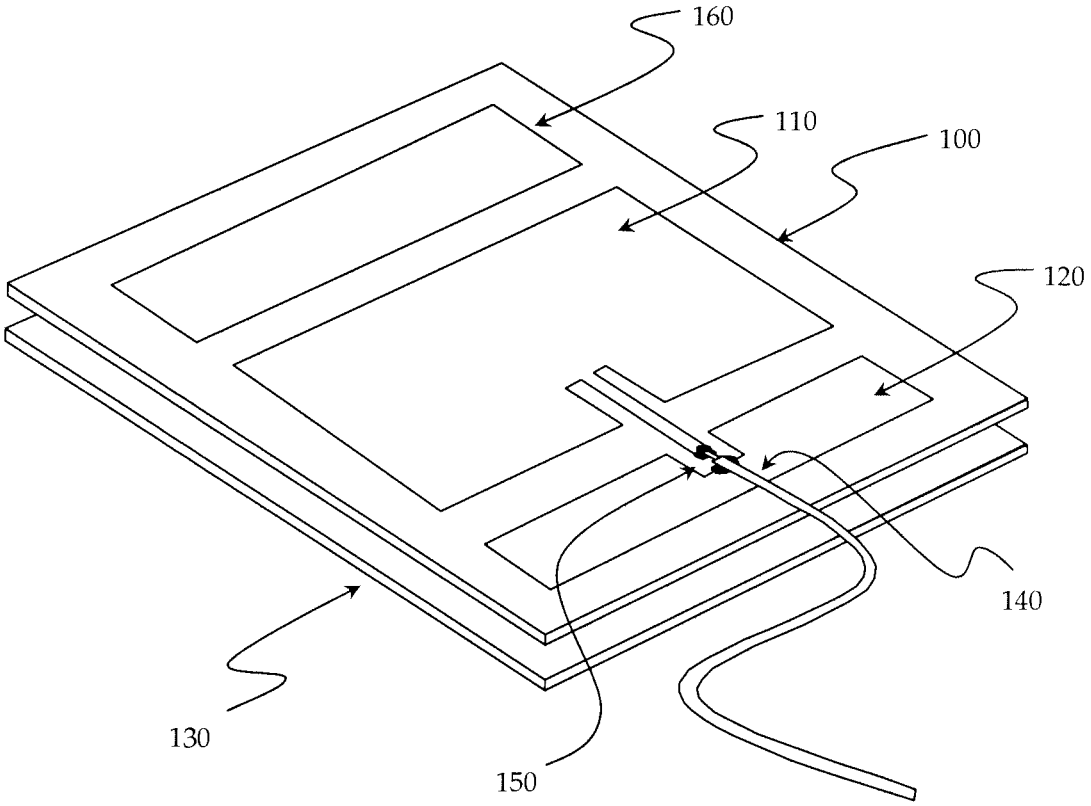
FIG. 5 Patch antenna with coplanar reference ground and coplanar floating ground, as described in the current invention.

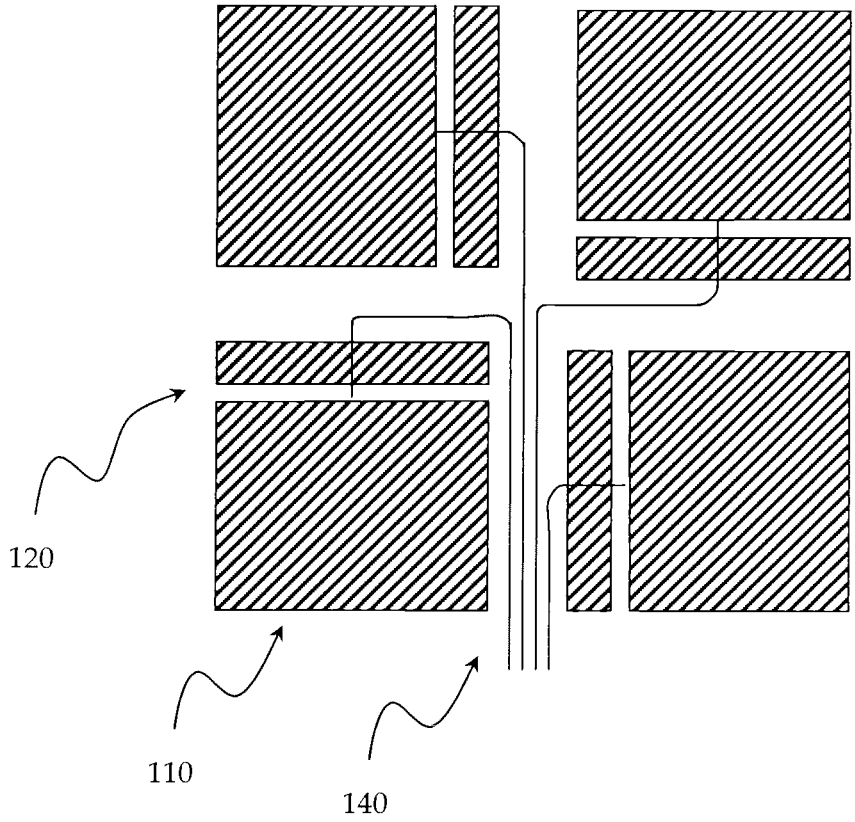
FIG. 6 An array of patch antennas of varying orientation.

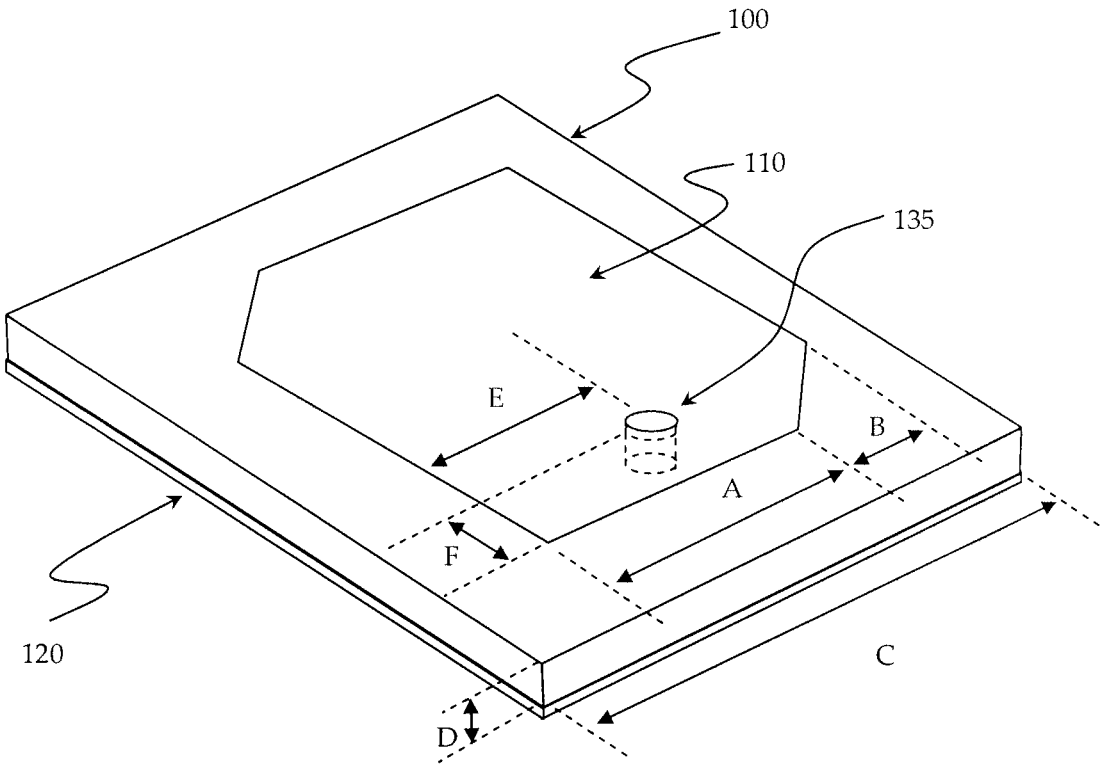
FIG. 7 Prior Art Patch Antenna Corresponding To Computer Simulation Results Provided In The Detailed Description Section

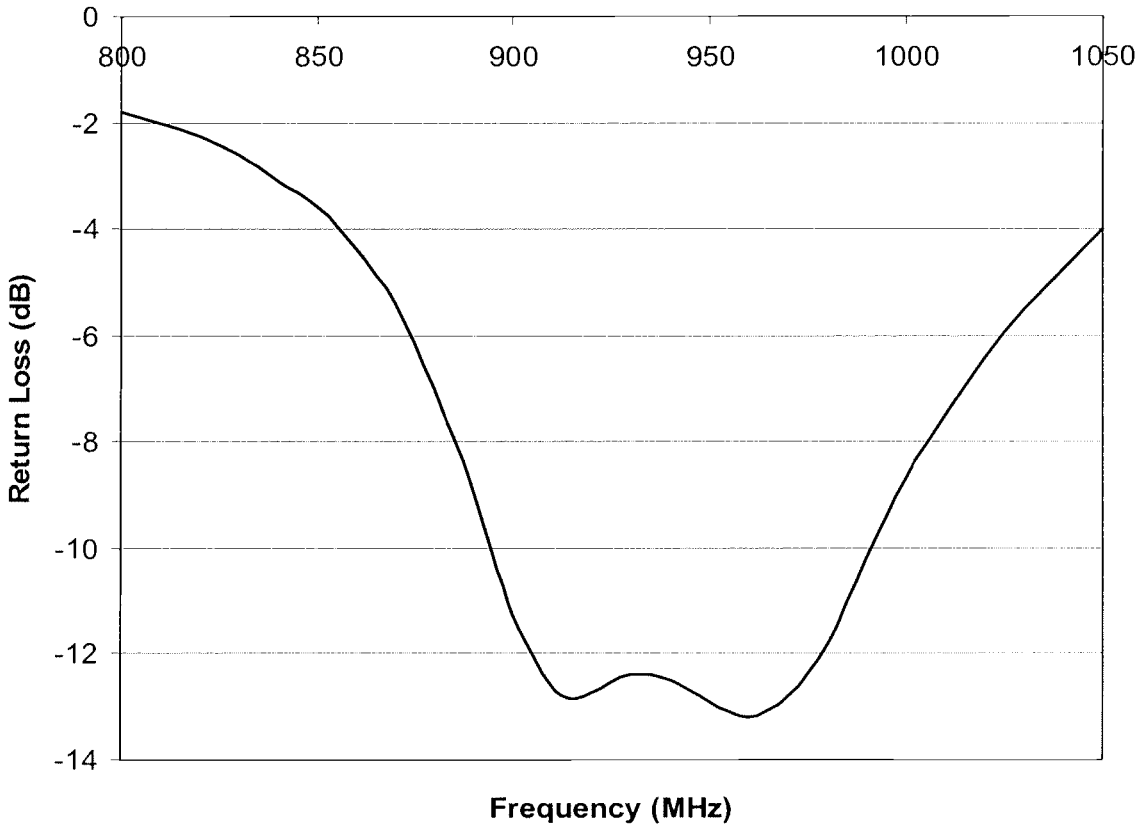
FIG. 8 Return Loss (Band Width) Plot for Prior Art Patch Antenna, of Design Shown in FIG. 7.

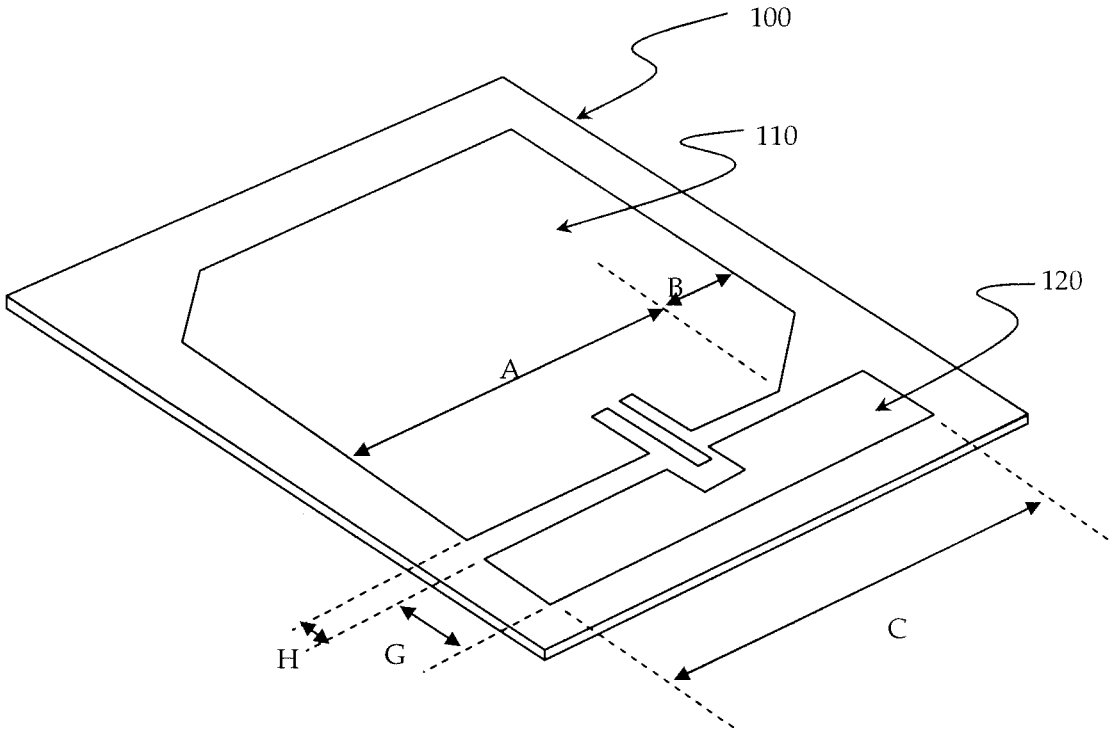
FIG. 9 Coplanar Reference Ground Patch Antenna Without Floating Ground Element, Corresponding To Computer Simulation Results Provided In The Detailed Description Section

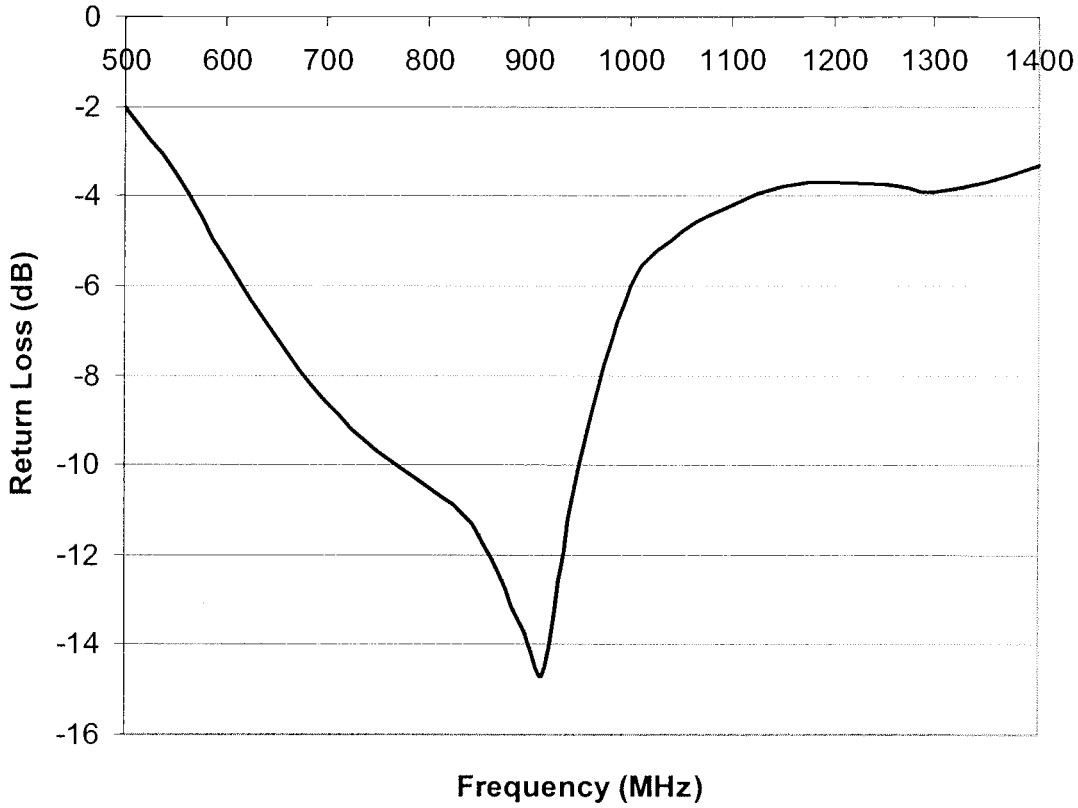
FIG. 10 Return Loss (Band Width) Plot for Coplanar Reference Ground Patch Antenna Without Floating Ground Element, of Design Shown in FIG. 9.

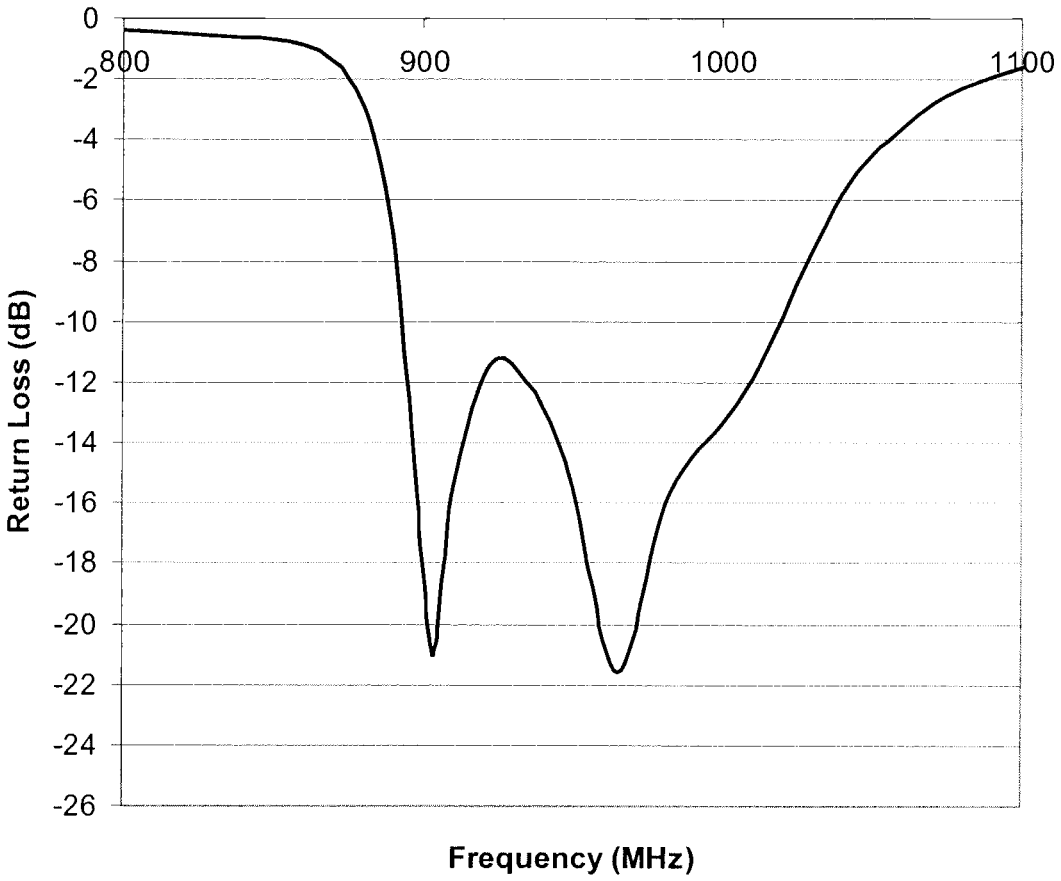
FIG. 11 Return Loss (Band Width) Plot for Coplanar Reference Ground Patch Antenna With Floating Ground Element.

RFID PATCH ANTENNA WITH COPLANAR REFERENCE GROUND AND FLOATING GROUNDS

This application claims priority to U.S. Application No. 60/978,389, entitled "RFID PATCH ANTENNA WITH COPLANAR REFERENCE GROUND AND FLOATING GROUNDS", filed on Oct. 8, 2007, which application is expressly incorporated by reference herein.

FIELD OF THE INVENTION

The present invention relates generally to a low-cost, low thickness, compact, wideband patch antenna with radiating element and reference ground conductor in the same geometric plane or closely spaced parallel planes, and optionally including floating ground conductors in the same geometric plane or closely spaced parallel planes, said patch antenna or arrays of such patch antennas having utility in radio frequency identification (RFID) applications in which UHF-band signals are passed between a reader (transceiver) and a tag (transponder) via the patch antenna. The invention is of particular use in RFID applications in which it is desirable to create a space with well-controlled directional UHF signal emission above a surface such as a smart shelf, smart countertop or other RFID-enabled surface, which space contains a collection of RFID tagged items, and such that the items in the space can be dependably read using UHF signals from the RFID reader attached to the antenna, without the complication of null zones or locations in the space at which the UHF signals are too weak to communicate with RFID tags.

BACKGROUND ART

Radio frequency identification (RFID) systems and other forms of electronic article surveillance are increasingly used to track items whose locations or dispositions are of some economic, safety, or other interest. In these applications, typically, transponders or tags are attached to or placed inside the items to be tracked, and these transponders or tags are in at least intermittent communication with transceivers or readers which report the tag (and, by inference, item) location to people or software applications via a network to which the readers are directly or indirectly attached. Examples of RFID applications include tracking of retail items being offered for public sale within a store, inventory management of those items within the store backroom, on store shelving fixtures, displays, counters, cases, cabinets, closets, or other fixtures, and tracking of items to and through the point of sale and store exits. Item tracking applications also exist which involve warehouses, distribution centers, trucks, vans, shipping containers, and other points of storage or conveyance of items as they move through the retail supply chain. Another area of application of RFID technology involves asset tracking in which valuable items (not necessarily for sale to the public) are tracked in an environment to prevent theft, loss, or misplacement, or to maintain the integrity of the chain of custody of the asset. These applications of RFID technology are given by way of example only, and it should be understood that many other applications of the technology exist.

RFID systems typically use reader antennas to emit electromagnetic carrier waves modulated and encoded with digital signals to RFID tags. As such, the reader antenna is a critical component facilitating the communication between tag and reader, and influencing the quality of that communication. A reader antenna can be thought of as a transducer which converts signal-laden alternating electrical current from the reader into signal-laden oscillating electromagnetic fields or waves appropriate for a second antenna located in the tag, or alternatively, converts signal-laden oscillating electromagnetic fields or waves (sent from or modified by the tag) into signal-laden alternating electric current for demodulation by and communication with the reader. Types of antennas used in RFID systems include patch antennas, slot antennas, dipole antennas, loop antennas, and many other types and variations of these types.

In the case of passive RFID systems, the RFID tag is powered by the electromagnetic carrier wave. Once powered, the passive tag interprets the radio frequency (RF) signals and provides an appropriate response, usually by creating a timed, intermittent disturbance in the electromagnetic carrier wave. These disturbances, which encode the tag response, are sensed by the reader through the reader's antenna. In the case of active RFID systems the tag contains its own power source, such as a battery, which it can use to either initiate RF communications with the reader by creating its own carrier wave and encoded RF signals, or else the tag power can be used to enhance the tag performance by increasing the tag's data processing rate or by increasing the power in the tag's response, and hence the maximum distance of communication between the tag and reader.

Especially for passive RFID systems, it is often convenient to distinguish the behavior of RFID systems and their antennas in terms of near-field versus far-field behavior. "Near-field" and "far-field" are relative terms, and it is with respect to the wavelength of the carrier wave that the terms "near" and "far" have meaning. When the distances involved in an application are much greater than the wavelength, the application is a far-field application, and often the antenna can be viewed as a point-source (as in most telecommunications applications). On the other hand, when the distances involved in an application are much shorter than the wavelength, the relevant electromagnetic interactions between antennas (e.g., reader antenna and tag antenna) are near-field interactions. In such a situation the reactive electric or magnetic component dominates the EM field, and the interaction between the two coupled antennas occurs via disturbances in the field. When the application of interest involves distances on the order of the wavelength of the carrier wave, the situation is more complex and cannot be thought of as simply near-field or simply far-field. Below this situation will be termed "mid-field".

Two common frequency bands used by commercial RFID systems are 13.56 MHz and UHF (approximately 850 to 960 MHz, with the specific band depending on the country in question). Since a tag on an RFID-tagged consumer item is generally used for many applications throughout the supply chain, from manufacturing and distribution to the final retail store location, the functional requirements of retail shelves are only one of the sets of factors influencing the choice of tag frequency. There are many factors and requirements of interest to various trading partners in the supply chain, and in this complex situation both 13.56 MHz and UHF are used extensively for tracking tagged items on and in smart shelving, racks, cabinets, and other retail, warehouse, and other business fixtures. U.S. Pat. Nos. 7,268,742, 6,989,796, 6,943,688, 6,861,993, 6,696,954, 6,600,420, and 6,335,686 all deal with RFID antenna applications to smart shelves, cabinets, and related fixtures. 13.56 MHz waves have a wavelength of just over 22 meters (72 feet), while the wavelength of UHF radiation used in RFID applications is approximately a third of a meter, or just one foot. Since the distances characteristic of item-level RFID applications involving the tracking and surveillance of tagged items on or in shelves, cabinets, racks, counters, and other such fixtures are on the order of feet (e.g., 0.5 fit to several feet), it is clear that, when UHF technology is used, the antenna interactions are neither near-field nor far-field, but rather are mid-field. In this case, a poor choice of reader antenna type, or the poor design of a proper type, can result in poor performance of the overall RFID system and application failure. One of the reasons for this is that in a mid-field situation the electric and magnetic fields emitting from the reader antenna vary significantly over the relevant surface (e.g., the surface of a retail shelf holding tagged items). The field may be strong in one place and much weaker in another place a few inches away (because the wavelength of UHF radiation is only a few inches), and the general behavior of the UHF system is much more complex than is observed in 13.56 MHz applications. Thus, in situations where UHF tags are used in RFID item tracking on shelves and other storage fixtures, the design of the reader antenna becomes critical. The current invention describes an approach to UHF antenna design which results in a uniform UHF emission zone immediately above the surface of the antenna (e.g., shelf surface) without large null (no-read) areas, and without requirement of a large antenna thickness which would limit the usefulness of the antenna design in practical retail and other business applications.

The detection range of passive RFID systems is typically limited by signal strength over short ranges, for example, frequently less than a few feet for passive UHF RFID systems. Due to this read range limitation in passive UHF RFID systems, many applications make use of portable reader units which may be manually moved around a group of tagged items in order to detect all the tags, particularly where the tagged items are stored in a space significantly larger than the detection range of a stationary or fixed reader equipped with one fixed antenna. However, portable UHF reader units suffer from several disadvantages. The first involves the cost of human labor associated with the scanning activity. Fixed infrastructure, once paid for, is much cheaper to operate than are manual systems which have ongoing labor costs associated with them. In addition, portable units often lead to ambiguity regarding the precise location of the tags read. For instance, the reader location may be noted by the user, but the location of the tag during a read event may not be known sufficiently well for a given application. That is, the use of portable RFID readers often leads to a spatial resolution certainty of only a few feet, and many applications require knowledge of the location of the tagged items within a spatial resolution of a few inches. Portable RFID readers can also be more easily lost or stolen than is the case for fixed reader and antenna systems.

As an alternative to portable UHF RFID readers, a large fixed reader antenna driven with sufficient power to detect a larger number of tagged items may be used. However, such an antenna may be unwieldy, aesthetically displeasing, and the radiated power may surpass allowable legal or regulatory limits. Furthermore, these reader antennas are often located in stores or other locations were space is at a premium and it is expensive and inconvenient to use such large reader antennas. In addition, it should be noted that when a single large antenna is used to survey a large area (e.g., a set of retail shelves, or an entire cabinet, or entire counter, or the like), it is not possible to resolve the location of a tagged item to a particular spot on or small sub-section of the shelf fixture. In some applications it may be desirable to know the location of the tagged item with a spatial resolution of a few inches (e.g., if there are many small items on the shelf and it is desired to minimize manual searching and sorting time). In this situation the use of a single large reader antenna is not desirable because it is not generally possible to locate the item with the desired spatial resolution.

Alternatively, a fully automated mobile antenna system can be used. U.S. Pat. No. 7,132,945 describes a shelf system which employs a mobile or scanning antenna. This approach makes it possible to survey a relatively large area and also eliminates the need for human labor. However, the introduction of moving parts into a commercial shelf system may prove impractical because of higher system cost, greater installation complexity, and higher maintenance costs, and inconvenience of system downtime, as is often observed with machines which incorporate moving parts. Beam-forming smart antennas can scan the space with a narrow beam and without moving parts. However, as active devices they are usually big and expensive if compared with passive antennas.

To overcome the disadvantages of the approaches described above, fixed arrays of small antennas are utilized in some UHF RFID applications. In this approach numerous reader antennas spanning over a large area are connected to a single reader or group of readers via some sort of switching network, as described for example in U.S. Pat. No. 7,084,769. Smart shelving and other similar applications involving the tracking or inventory auditing of small tagged items in or on RFID-enabled shelves, cabinets, cases, racks, or other fixtures can make use of fixed arrays of small antennas. In tracking tagged stationary items in smart shelving and similar applications, fixed arrays of small antennas offer several advantages over portable readers, systems with a single large fixed antenna, and moving-antenna systems. First, the antennas themselves are small, and thus require relatively little power to survey the space surrounding each antenna. Thus, in systems which query these antennas one at a time, the system itself requires relatively little power (usually much less than 1 watt). By querying each of the small antennas in a large array, the system can thus survey a large area with relatively little power. Also, because the UHF antennas used in the antenna array are generally small and (due to their limited power and range of less than 1-12 inches) survey a small space with a specific known spatial location, it must also be true that the tagged items read by a specified antenna in the array are also located to the same spatial resolution of 1-12 inches. Thus systems using fixed arrays of small antennas can determine the location of tagged items with more precision than portable RFID readers and systems using a small number of relatively large antennas. Also, because each antenna in the array is relatively small, it is much easier to hide the antennas inside of the shelving or other storage fixture, thus improving aesthetics and minimizing damage from external disruptive events (e.g., children's curiosity-driven handling, or malicious activity by people in general). Also, an array of fixed antennas involves no moving parts and thus suffers from none of the disadvantages associated with moving parts, as described above. Also, small antennas like those used in such antenna arrays may be cheaper to replace when a single antenna element fails (relative to the cost of replacing a single large antenna). Also, fixed arrays of antennas do not require special manual labor to execute the scanning of tagged items and, therefore, do not have associated with them the high cost of manual labor associated with portable reader and antenna systems, or with mobile cart approaches.

In smart shelving and similar applications it is often important for economic and aesthetic reasons that the antennas used in the antenna array be simple, low cost, easy to retrofit into existing infrastructure, easy to hide from the view of people in the vicinity of the antennas, and that the antennas can be installed and connected quickly. These application requirements are more easily met with an antenna configuration which minimizes the number of layers used in the antenna fabrication, and which also minimizes the overall antenna thickness. That is, thin or low profile antennas are easier to hide, and easier to fit into existing infrastructure without requiring special modification to that existing infrastructure. Also, reducing layers in the antenna tends to reduce antenna cost. For reasons of cost and installation convenience it is also desirable to have the simplest possible approach to the attachment of the RF feed cables or wires to the antennas. Preferably, the attachment should be made in one location, on one surface, without requiring a hole or special channel, wire, or conductive via through the antenna substrate. This last requirement is especially important in large-volume manufacture of the antenna systems since, in that case, the final assembly will usually involve a few hand assembly steps carried out by an electronics technician on an assembly line, and elimination of one or several steps will significantly reduce the total production cost. It is also important that the design of the UHF antennas allows for reading of RFID tags in the space near the antennas without "dead zones" or small areas between and around antennas in which the emitted fields are too weak to facilitate communication between the tag and reader. Another requirement for the antennas used in smart shelf and similar applications is that they have the ability to read items with a diversity of tag antenna orientations (i.e., tag orientation independence, or behavior at least approaching that ideal).

Traditional patch antennas, slot antennas, dipole antennas, and other common UHF antenna types which might be used in antenna systems such as those described above generally involve multiple layers. U.S. Pat. No. 6,639,556 shows a patch antenna design with this layered structure and a central hole for the RF feed. U.S. Pat. No. 6,480,170 also shows a patch antenna with reference ground and radiating element on opposing sides of an intervening dielectric. A multi-layer antenna design can lead to excessive fabrication cost and excessive antenna thickness (complicating the retrofitting of existing infrastructure during antenna installation, and making it more difficult to hide the antennas from view). Multi-layer antenna designs also tend to complicate the form of the attachment of the connecting wires (for example, co-axial cable between the antenna and reader) since the connections of the signal carrier and reference ground occur on different layers, and this increases the cost of the antenna for the reasons described above.

For UHF smart shelving applications the patch antenna is a good choice of antenna type because the fields emitted from the patch antenna are predominantly in the direction orthogonal to the plane of the antenna, so the antenna can be placed on or inside the shelf surface and create an RFID-active space in the region immediately above the shelf, and read the tagged items sitting on the surface of the shelf with relative ease. Of course, this presupposes that the particular patch antenna design yields sufficient bandwidth and radiation efficiency to create, for a given convenient and practical power input, a sufficiently large space around the antenna wherein tagged items can be dependably and consistently read. The traditional patch antenna described in the prior art has a main radiative element of conductive material fabricated on top of a dielectric material. Beneath (i.e., on the reverse side of) the dielectric material is typically located a reference ground element, which is a planar layer of conductive material electrically grounded with respect to the signals being transmitted or received by the antenna. In the typical patch antenna design well known in the prior art, the antenna main radiative element and the reference ground element are in parallel planes separated by the dielectric material (which, in some cases, is simply an air spacer). Also, in the usual case, the main radiative element and the reference ground element are fabricated with one directly above the other, or with one substantially overlapping with the other in their respective parallel planes. A disadvantage of this traditional multi-layer patch antenna design is that the connection of the shielded cable or twisted pair wire carrying signals between the antenna and the RFID reader must be attached to the antenna on two separate levels separated by the dielectric material, thus requiring a connecting hole or via in the dielectric layer.

The size of the gap between the radiating element and the reference ground conductor (i.e., the dielectric layer thickness) is a critical design parameter in the traditional patch antenna since, for a given dielectric material, the thickness of this gap largely determines the bandwidth of the antenna. As the gap is reduced, the bandwidth is narrowed. If the bandwidth of the antenna is too narrow, the tuning of the antenna in a given application becomes very difficult, and uncontrollable changes in the environment during normal operation (such as the unanticipated and random introduction of metal objects, human hands, or other materials into the area being monitored by the antenna) can cause a shift in resonance frequency which, combined with the overly narrow bandwidth, causes failure in RFID tag detection and reading. Thus, for a given application there is for practical reasons a lower limit on the distance between the ground plane and the radiating element in a traditional patch antenna design, and this constrains the overall thickness of the antenna.

Another constraint on the thickness of a traditional patch antenna stems from radiation efficiency (fraction of total electrical energy put into the antenna which is emitted as electromagnetic radiation). If the dielectric thickness or gap between the reference ground and radiating element is too small, the radiating efficiency will be too low, and too much of the power to the antenna is wasted as heat flowing into the dielectric and surroundings.

The discussion above makes it clear that (1) a patch antenna design can be used effectively in UHF smart shelf and similar applications, and (2) use of the patch type of antenna would be even more advantageous, and satisfy the previously discussed practical requirements of smart shelving more completely if there were some way of overcoming the constraints on the thickness of the antenna imposed by the requirements of high bandwidth and radiation efficiency. Also, it would be advantageous to find a new design for the patch antenna which simplifies the attachment of the feed cable or wire. In addition, it would be advantageous to find a new antenna design which spread the UHF radiation more evenly and over a greater area of the surface of the shelf containing the antenna (i.e., in the region above the radiating element plane) than is possible for the traditional patch antenna design. As noted above, the relatively short wavelength (approximately 12 inches) of UHF emissions can present challenges to the designers of UHF smart shelving who want to be able to effectively and consistently read tags at any location on the shelf. A better UHF antenna design would minimize this problem, and allow better "field spreading" or "field shaping" in the regions immediately above and around the edges of the antenna.

The current invention overcomes the above-mentioned limitations of the traditional patch antenna design, and results in a new patch antenna which is much thinner without sacrificing bandwidth and radiation efficiency. Also, the current invention allows for a much more simple antenna feed cable attachment than is possible with the traditional patch antenna approach. Also, the current invention allows for a more evenly distributed UHF field around the antenna which makes it easier to avoid dead zones, and allows the smart shelf designer to spread or shape the field evenly around the antenna. In contrast to this prior art, the current invention describes an antenna in which the main radiative element is placed in a common geometric plane, or substantially the same plane, with the reference ground element, or in which the main radiative element and reference ground element are placed in two parallel, closely spaced planes separated by a dielectric laminate, with little or no overlap between the main radiative element and the reference ground element. That is, a key invention described in this specification is a patch antenna in which the main radiative element and the reference ground element are in the same plane, or in two closely-spaced parallel planes, with the two elements substantially side-by-side rather than one directly over the other, or rather than one substantially overlapping with the other. This cost-efficient antenna configuration, particularly when implemented with a floating ground plane or planes in addition to the reference ground element, and with the floating ground plane or planes located beneath the plane holding the main radiative element and reference ground, results in superior antenna gain, bandwidth, and tuning robustness in RFID smart shelf applications, as well as similar applications in which it is desired to interrogate a number of RFID tags located in close proximity, with low-power RFID signals localized in a small physical space which would normally result in tuning difficulties for traditional patch antennas. A further advantage of the current invention is that the newly invented patch antenna is thinner than a typical patch antenna described in the prior art. That is, by locating the main radiative element and the reference ground element in the same plane, or substantially the same plane with little or no overlap, a thinner patch antenna can be designed for a given high bandwidth, radiative efficiency, and robust frequency response requirement.

SUMMARY OF THE INVENTION

In accordance with the preferred embodiment of the invention, reader antennas are provided within storage fixtures (for example, shelves, cabinets, drawers, or racks) for transmitting and receiving RF signals between, for example, an RFID reader and an RFID tag or transponder. The reader antennas may be placed in a variety of configurations which include but are not limited to configurations in which, for each antenna, the main radiative antenna element and the reference ground element for the antenna are located within the same physical or geometric plane, or in two parallel closely spaced planes separated by a dielectric laminate, with little or no overlap between the radiative antenna element and the reference ground element.

Also, as an option, one or more floating ground plane(s) may be included in the same plane as or in a plane parallel to the radiative antenna element's geometric plane to improve, control, or optimize the electric or magnetic field strength or shape around the antenna.

In the preferred embodiment, the RFID-enabled storage fixtures are equipped with multiple patch antennas, each patch antenna having its own reference ground element coplanar with or substantially coplanar with the respective patch antenna's main radiative element.

Furthermore, in the preferred embodiment, these RFID-enabled fixtures are implemented using an intelligent network in which the antennas are selected, activated, and otherwise managed by a supervisory control system consisting of one or more controllers and a host computer or host network.

These and other aspects and advantages of the various embodiments will be described herein below.

BRIEF DESCRIPTION OF THE DRAWINGS

FIG. 1 shows a patch antenna design typical of the prior art.

FIG. 2 shows a patch antenna with coplanar reference ground, as described in the current invention.

FIG. 3 shows a detail drawing of the coaxial cable connection to the antenna patch and reference ground planes, as described in the current invention.

FIG. 4 shows examples of alternative patch antenna shapes.

FIG. 5 shows an example of a patch antenna in which an additional floating ground element has been placed in the same plane as that containing the radiative antenna element and reference ground element.

FIG. 6 shows an array of patch antennas of varying orientation.

FIG. 7 shows a prior art patch antenna corresponding to the computer simulation results provided in the detailed description of the current invention.

FIG. 8 shows the return loss (band width) plot for the prior art patch antenna, of design shown in FIG. 7.

FIG. 9 shows a coplanar reference ground patch antenna without floating ground element, corresponding to computer simulation results provided in the detailed description of the current invention.

FIG. 10 shows the return loss (band width) plot for the coplanar reference ground patch antenna without floating ground element, of design shown in FIG. 9.

FIG. 11 shows the return loss (band width) plot for a coplanar reference ground patch antenna with floating ground element.

DETAILED DESCRIPTION OF THE INVENTION

Preferred embodiments and applications of the current invention will now be described. Other embodiments may be realized and changes may be made to the disclosed embodiments without departing from the spirit or scope of the invention. Although the preferred embodiments disclosed herein have been particularly described as applied to the field of RFID systems, it should be readily apparent that the invention may be embodied in any technology having the same or similar problems.

In the following description, a reference is made to the accompanying drawings which form a part hereof and which illustrate several embodiments. It is understood that other embodiments may be utilized and structural and operational changes may be made without departing from the scope of the descriptions provided.

FIG. 1 is a drawing showing a patch antenna from the prior art. In this design the supporting dielectric material 100 separates the radiative antenna element 110 (top side of the dielectric) and the reference ground element 120 (bottom side of the dielectric). Feed point 135 requires a hole in the dielectric so that the ground element of the feed cable (not shown) can be attached to the reference ground 120.

FIG. 2 is a drawing illustrating an exemplary patch antenna assembly in accordance with the preferred embodiment of the current invention. In the preferred embodiment a first supporting dielectric material 100 like that commonly used in printed circuit boards is used to support the radiative antenna element 110 and reference ground element 120. Floating ground 130 is a solid metal sheet or is printed on the circuit board, and is separated from the first printed circuit board by an air-filled space. The size of the air space or gap is maintained in the preferred embodiment by a non-conductive support which holds the edges of the two printed circuit boards at a fixed distance of separation. The antenna patch 110, reference ground 120 and floating ground 130 are typically comprised of solid copper metal plating, but it should be immediately clear to those skilled in the art that other types of electrically conductive materials may be used for these elements of the antenna assembly. Signals are fed to the antenna at point 150 where, in the preferred embodiment, a coaxial cable has been attached with the cable's core conductor soldered to the radiative antenna element and the cable shielding mesh soldered to the reference ground element, as shown. In the preferred embodiment the total separation between the antenna patch 110 and the floating ground 130 is between 0.125 inches and 0.5 inches, but larger or smaller separations can also be used. The rigid dielectric laminates supporting the antenna patch 110, reference ground 120, and floating ground 130 are typically between 0.025 inches and 0.060 inches, while thickness of other flexible materials, such as Mylar or FR4 or other similar material, can be as low as a few mils. Easy feeding is an obvious advantage of this configuration since the radiative antenna element 110 and the reference ground element 120 are in the same plane and situated close to each other.

In one embodiment of making the FIG. 2 embodiment patch antenna, the radiative antenna element, also referred to as patch 110, and the reference ground element 120 can be fabricated by copper or other metal patterns etched or patterned or deposited onto the surface of the dielectric material 100, which can be a polyester or other plastic or polymer sheet, such as Mylar or FR4.

The antenna assembly shown in FIG. 2 provides wide bandwidth with three resonant frequencies, which is realized by placing the reference ground element in the same plane with the radiative antenna element. Because the reference ground is a metalized rectangular patch, it generates the third resonant frequency when it is coupled to the main (radiative) patch. This third resonant frequency can be tuned by adjusting the dimensions of the reference ground. The sizes of the reference ground element and radiative antenna element, the distance between the reference ground element and the radiative antenna element, and the feeding location are determined by the resonance frequency band, the bandwidth, and polarization requirements. By carefully selecting the values for the variables mentioned above, one can produce an antenna with three resonance peaks spreading over the desired band. The high antenna bandwidth of the current invention is one of the most important advantages over the prior art antenna designs.

In the preferred embodiment of the current invention a physical connection via an electrical conductor 137 is often made between the radiative antenna element 110 and the floating ground 130. Because of this electric DC short between the radiative element and the floating ground, there is no DC voltage difference between them, and this connection greatly reduces the tendency for the electronic system to experience failure due to ESD (electrostatic discharge).

FIG. 3 shows in more detail the connection of a coaxial cable 140 to the antenna patch 110 and reference ground 120. In the preferred embodiment of the invention the coaxial cable is a shielded cable commonly used in RFID and other radio frequency applications. Typically the RF signal is carried by voltage variations in the cable's copper core 144, relative to or referenced to the voltage in the cable's metal mesh shielding wrap 142. The core 144 and shielding wrap 142 are separated by a dielectric insulation material 143. In the preferred embodiment the cable core 144 is soldered to the antenna patch 110 with solder 148, and the shielding wrap 142 is soldered to the reference ground 120 with solder 146. Alternatively, different types of connectors, such as SMA, can also be used to connect the antenna and the system.

The antenna, in its various embodiments as described in the current invention (and in other embodiments which after consideration of the structures and approaches taught in the current invention may be easily conceived by one skilled in the art) may be fed by an RF signal from external circuitry (not shown) through a means such as a coaxial cable, as shown in FIG. 2. The external circuitry may be, for example, a switch device, an RFID reader, an intelligent network (as described in U.S. patent application Ser. No. 11/366,496, which claims priority to U.S. Provisional Application No. 60/673,757), or any known component or system for transporting RF signals to and from an antenna structure. It should be recognized that the antenna feed point or point of attachment shown in FIG. 2 and FIG. 3 is only one example, and it is also possible to attach the core 144 to other points on the antenna patch 110. Also, it is possible to choose various points of attachment for the shielding wrap 142 on the reference ground 120. The particular choice of these points of attachment depend upon the antenna bandwidth and gain required in the particular antenna application, and upon the application-specific requirements for the shape and symmetries of the electric and magnetic fields to be established by the antenna. The attachment alternatives are too numerous to be enumerated here, but should be clear to one skilled in the art, after consideration of the structures and approaches taught, by way of example, in the current invention.

It should be clear to one skilled in the art that the coaxial cable 140 shown in the figures of the current invention may be replaced by any other appropriate cable, cord, or wire set capable of carrying the signal and reference voltages needed in the application addressed by the current invention, and this replacement may be made without departing from the spirit of the current invention.

The radiative antenna element 110 may be implemented in any pattern or geometrical shape (e.g., square, rectangular, circle, free flow, etc.). Several of these shape alternatives are shown in FIG. 4, including a rectangular shape 310, rectangular shape with trimmed corners along one diagonal 320, rectangular shape with a slot 330, rectangular shape with two orthogonal slots 340, circular shape 350, circular shape with a slot 360, and circular shape with two orthogonal slots 370. These alternatives are shown by way of example only and are not intended to limit the scope and application of the current invention.

The radiative antenna element 110 may be made up of a metal plate, metal foil, printed or sprayed electrically conductive ink or paint, metal wire mesh, or other functionally equivalent material (e.g., film, plate, metal flake, etc.). The material of antenna substrate 100 is a dielectric material (e.g., the material typically used for printed circuit boards) or any other material having negligible electrical conductivity (including a combination of two or more different types of such negligibly conductive material, as may be used in a laminated or layered structure).

The cable 140 may have at either end, or located along its length, tuning components (not shown) such as capacitors and inductors. The sizes (e.g., capacitance or inductance) of these tuning components are chosen based on the desired matching and bandwidth characteristics of the antenna, according to practices well known to those skilled in the art.

The feed points for the radiative antenna element 110 and reference ground element 120, the separation distance between the radiative antenna element 110 and reference ground element 120, the shapes of the radiative antenna element 110 and reference ground element 120, the size and placement of slots or other voids in the radiative antenna element 110 and/or reference ground element 120, as well as the presence or absence of the floating ground 130, its size and shape, the separation distance between the radiative antenna element 110 and the floating ground 130, and the location of or presence of an electrical connection or "short" between the radiative antenna element 110 and floating ground 130, may each individually or together be adjusted to optimize the antenna gain, the shapes of the electric and magnetic fields set up by the antenna when driven by a particular signal, and the power consumed by the antenna when driven by that signal. Also, the above characteristics of the antenna and its various components, particularly the characteristics of antenna element slots, slits, and cut corners, can be adjusted to reach the desired antenna size and cause the antenna to be polarized in a direction favorable for reading RFID tags placed on objects to be detected by the antenna. For example, the antenna may be given a linear polarization in a direction favorable for reading tags placed upon objects in a particular orientation. The tag location or position may cooperate with the antenna polarization, if any, for favorably reading the tag. The details of the slits or slots, and nature of the cut corners, also have a significant effect on the frequency response of the antenna, and can be used to increase the bandwidth of the antenna. The third resonant frequency introduced by the use of one or more floating ground elements extends the bandwidth, while a traditional patch antenna only has one or two resonant frequencies.

For antenna designs typical of the prior art, the placement of metal objects below the antenna changes the resonance frequency of the antenna and can cause serious detuning. This problem has been greatly relieved by the current invention. The antenna structure of the preferred embodiment of the current invention performs well even when a metal plate or other conductive object is placed closely below the antenna structure (such as a metal retail or storage shelf) due to the constrained EM field. Because the floating ground introduced for the metal shelf works as a reflector, the radiation can only happen in one direction. Therefore, the antenna has higher gain, but usually reduced bandwidth.

FIG. 5 shows an example of a patch antenna in which the radiative antenna element 110, reference ground element 120, and one floating ground element 160 have been placed in a common plane. In this example, another floating ground plane 130 is also present in a second plane. Placing a floating ground element in the same plane as the reference ground and radiative element gives greater bandwidth. FIG. 5 shows only one additional (coplanar) floating ground, but more than one can be employed to shape the fields around the antenna and optimize the radiation pattern for the application at hand.

Detailed computer simulations were undertaken to demonstrate some of the advantages of the current invention relative to the prior art. FIG. 7 shows a particular embodiment of the prior art patch antenna having a square radiative antenna element with cut corners (for production of circularly polarized fields), and a square reference ground element in a plane below the plane of the radiative antenna element. The distance A in FIG. 7 is 4.65 inches, and distance B is 1.3 inches. Note that the corner cuts were made at a 45 degree angle. The distance C (edge length of the reference ground element) is 8 inches. The distance D between the two planes in FIG. 7 is 0.5 inches. The feed point for the antenna in FIG. 7 is located 2.975 inches from the side of the radiative element (distance E) and 0.415 inches from the front edge of the radiative element (distance F). In the simulation, air was used as the dielectric between the two planes. Copper properties were used for the radiative element and the reference ground. The substrate supporting the radiative element and the reference ground was assumed to be FR402 (62 mils thick), a common substrate material used in the printed circuit board industry. The material surrounding the antenna was assumed to be air. FIG. 8 shows the return loss in dB, as a function of frequency, for the antenna described by FIG. 7. At −8 dB, the bandwidth exhibited is approximately 13%. At −10 dB the bandwidth is about 10%.

FIG. 9 shows a particular embodiment of the current invention having a square radiative antenna element with 45-degree cut corners and a coplanar rectangular reference ground element. The distance A in FIG. 9 is 3.94 inches, and the distance B is 1.34 inches. The length C of the reference ground element 120 is 5.28 inches, and its width G is 0.63 inches. The gap H between the radiative antenna element 110 and the reference ground element 120 is 0.28 inches. As in the simulation corresponding to the antenna in FIGS. 7 and 8, that of FIG. 9 assumed copper properties for the radiative element and the reference ground. The substrate supporting the radiative element and the reference ground was assumed to be FR402, with a thickness of 62 mils. The material surrounding the antenna was assumed to be air. FIG. 10 shows the return loss in dB, as a function of frequency, for the antenna described by FIG. 9. At −8 dB, the bandwidth exhibited is approximately 30%. At −10 dB the bandwidth is about 20%. Thus, the bandwidth of the antenna of the current invention is significantly greater than that of the prior art, as demonstrated in these simulation results.

Additional simulations were carried out in which a floating ground element was placed 0.5 inches below the antenna of FIG. 9. The resulting return loss plot is shown in FIG. 12. Note the introduction of additional resonance peaks by the presence of the floating ground element. The bandwidth of this antenna design is less than that of the antenna shown in FIG. 9 (without a floating ground), but greater than the bandwidth of the prior art patch antenna shown in FIG. 7.

In another embodiment of the current invention, the patch antenna assembly of FIG. 2 can be used in the form of an array of antenna assemblies, as shown in FIG. 6. Similar to the antenna assembly of FIG. 2, each antenna assembly in the array of FIG. 6 may have its own radiative antenna element 110, reference ground element 120, and feed cable 140. In one embodiment of the current invention, all of the antennas in the array can be mounted on a single (common) printed circuit board and make use of a single (common) floating ground element. Alternatively, a separate substrate and floating ground element can be used for each antenna assembly in the array.

In an array such as that shown in FIG. 6, the orientation of each antenna assembly (with respect to orientation around an imaginary axis perpendicular to the radiative antenna element and running through its center) can be varied, or else each antenna assembly in the array may have the same rotational orientation.

By arranging antenna assemblies into an array such as that shown in FIG. 6, it is possible to cover a larger physical area on a retail store shelf, storehouse or distribution center rack, counter top, or other physical space of relevance in an RFID tag reading application, or other RF communications application. In such an approach, a relatively large number of relatively small antennas can be used, with each antenna in the array being queried, as required, by the antenna network control system, host RFID reader, or other host system. Examples of such networks and control systems can be found in U.S. patent application Ser. No. 11/366,496, which claims priority to U.S. Provisional Application No. 60/673,757, which are expressly incorporated by reference herein.

In an additional embodiment of the current invention, the array of antenna assemblies, such as but not limited to the example shown in FIG. 6, may be enclosed in a housing, fixture, or shell, such as a retail store shelf, cabinet, warehouse shelf or rack, retail store countertop, or some other commercial or home storage or work fixture. The material used in the housing, fixture, or shell may be selected from a wide variety of materials, including wood, plastic, paper, laminates made from combinations and permutations of wood, plastic, and paper, or metal, or combinations of metal and other dielectric materials. In such housings, fixtures, or shells enclosing the array of antenna assemblies, the placement of any and all metal components may be made according to the demands of structure strength, integrity, and aesthetics, in such a way as to allow electromagnetic fields from the antennas in the array to be projected out into the space above, below, or around the housing, fixture, or shell, such as the application may demand.

One embodiment of the current invention, described by way of example, is a solid metal retail shelf upon which an antenna assembly array, such as that shown in FIG. 6, is placed with the antenna patch and reference ground side of the antenna assemblies facing up and away from the metal shelf, and fixed in place with adhesive or metal screws, and covered with a plastic shell for protection of the antenna components and improvement of the aesthetics as required in the application. For such an embodiment, and in the case of other embodiments which might be imagined which have solid and relatively extensive pieces of metal on the floating ground side of the antenna assemblies, the highly directional gain of the antenna created by the configuration of the radiative antenna element 110, reference ground element 120, and floating ground 130 create a desirable situation in which the behavior of the antennas, including their tuning and gain, are insensitive to variations in the size, shape, conductivity, and other characteristics of the metal shelf upon which the array of antenna assemblies has been placed. This is because the floating ground creates uniformity of electric potential in its plane and shields everything beyond it (on the side opposite the patch) from the electric and magnetic fields which would otherwise be emitted on that side of the antenna. In other words, the use of the floating ground in between the radiative antenna element/reference ground plane and the metal of the shelf makes the antenna assembly "one-sided" in its behavior, and keeps the oscillating fields on the upper side of the antenna assembly (on the side of the antenna assembly opposite the metal of the shelf). This insensitivity to the particulars of the design of the metal shelf offers greater flexibility in the application of a single antenna assembly array design to multiple and varied shelf fixtures, and eliminates the need for extensive re-design or customization of the patch antenna when moving from one application to another.

In another embodiment of the current invention, the metal of the retail shelf may itself be used as a floating ground or, alternatively, the shelf may be constructed such that a common sheet of metal is used as both a floating ground plane and also a physical support for the antenna assembly or antenna assembly array, as well as objects which may be placed upon the fixture, such as retail items holding RFID tags.

The current invention explicitly includes and encompasses all embodiments which may be imagined by variation of one or more features of the embodiments described in this specification, including radiative antenna element size, shape, thickness, void or slot shape, reference ground element size, shape, placement within the two dimensions of the plane occupied by the radiative antenna element, distance separating the radiative antenna element and reference ground element, position and manner of attachment of the signal feed line or cable to the radiative antenna element and reference ground element, presence or absence of one or more floating ground elements, size, shape, or thickness of the floating ground plane, separation distance between the floating ground and the radiative antenna element, the dielectric material or materials used to separate the radiative antenna element from the reference ground and floating ground, the conductive material or materials used to fabricate the radiative antenna element, reference ground, and floating ground, the number of antenna assemblies used in the array, or materials and structures used to house and protect the antenna assembly or antenna assembly array.

The current invention also encompasses all embodiments in which the antenna assembly array is replaced by a single antenna assembly (i.e., with a single patch antenna).

It should also be noted that various arrays of antenna assemblies may be constructed in which the antenna assemblies occupy two different planes. For example, one may build an array of antenna assemblies in which some of the assemblies are located inside a first geometric plane, and the remainder of the assemblies are located inside a second geometric plane orthogonal to the first geometric plane. This embodiment is given by way of example only, and it should be noted that the two planes need not necessarily be orthogonal. Also, it is conceivable that more than two geometric planes may be used in the placement of the antenna assemblies. Such a multi-planar array of antenna assemblies may improve the robustness of the array in some applications in which, for instance, the orientation of the RFID tags to be interrogated by the antennas is not known, or is known to be random or varying. In addition, the application may demand specific electrical or magnetic field polarization which may be produced by placement of the antenna assemblies in several planes. All of the embodiments which may be imagined for the placement of multiple antenna assemblies in multiple planes are explicitly included in the current invention.

Other embodiments of the current invention may be imagined in which the radiative antenna element 110 of the antenna assembly shown in FIG. 2 is replaced with a slot antenna, antenna loop or planar coil, or some other type of antenna radiator element. Such a replacement can be imagined in any of the invention embodiments described in this specification, and all of the additional embodiments which can be imagined by such as replacement are explicitly included in the current invention.

While embodiments have been described in connection with the use of a particular exemplary shelf structure, it should be readily apparent any shelf structure, rack, etc. (or any structure, such as antenna board, shelf back, divider or other supporting structure) may be used in implementing the invention, preferably, for use in selling, marketing, promoting, displaying, presenting, providing, retaining, securing, storing, or otherwise supporting an item or product.

Although specific circuitry, components, modules, or dimensions of the same may be disclosed herein in connection with exemplary embodiments of the invention, it should be readily apparent that any other structural or functionally equivalent circuit(s), component(s), module(s), or dimension(s) may be utilized in implementing the various embodiments of the invention. It is to be understood therefore that the invention is not limited to the particular embodiments disclosed (or apparent from the disclosure) herein, but only limited by the claims appended hereto.

What is claimed as new and desired to be protected by Letters Patent of the United States is:

1. An antenna assembly, comprising:

a planar laminate;

a planar electrically conductive area of predetermined shape and dimension forming a radiative antenna element on the planar laminate;

another planar electrically conductive area of predetermined shape and dimension forming a reference ground element on the planar laminate, such that the radiative antenna element and the reference ground element are coplanar, and wherein there is no substantial overlap between the radiative antenna element and the reference ground element;

a first planar electrically conductive floating ground element that is oriented parallel to the radiative antenna element and the reference ground element, that is separated from the planar laminate by an air-filled space, and that is electrically connected directly to the radiative antenna element; and a second planar electrically conductive floating ground element on the planar laminate and coplanar with the radiative antenna element and the reference ground element;

wherein the radiative antenna element is substantially larger than the reference ground element and the second floating ground element.

2. The antenna assembly of claim 1 wherein the radiative antenna element and the reference ground element are formed by a conductor disposed on the planar laminate, the planar laminate being one of a polyester sheet, a plastic sheet, Mylar, FR4, and a polymer sheet.

3. The antenna assembly of claim 2 wherein the planar laminate has a thickness of less than 0.125 inches.

4. The antenna assembly of claim 1, wherein the radiative antenna element and the reference ground element are formed on opposite sides of the planar laminate.

5. The antenna assembly of claim 1, wherein the radiative antenna element and the reference ground element are formed on a same side of the planar laminate.

6. The antenna assembly of claim 1 wherein the planar laminate has a thickness of less than 0.125 inches.

7. The antenna assembly of claim 6 wherein the radiative antenna element is comprised of a conductive material layer and the predetermined shape is a non-geometric shape.

8. The antenna assembly of claim 6 wherein the radiative antenna element is comprised of a conductive material layer and the predetermined shape is a geometric shape.

9. The antenna assembly of claim 8 wherein the geometric shape consists of one of the following shapes: rectangular, circular, triangular, rectangular with angled corners along one diagonal, and rectangular with one or more rectangular slots.

10. The antenna assembly of claim 1 further including a second planar electrically conductive area of predetermined shape and dimension forming a second radiative antenna element on the planar laminate, such that the radiative antenna and the second radiative antenna are on a same first plane, and a second planar electrically conductive area of predetermined shape and dimension forming a second reference ground element on the planar laminate, such that the reference ground element and the second reference ground element are on a same second plane, and wherein there is no substantial overlap between the second radiative antenna element and the second reference ground element.

11. The antenna assembly of claim 10 wherein the radiative antenna element, the reference ground element, the second radiative antenna element and the second reference ground element are formed on a same side of the planar laminate.

12. The antenna assembly of claim 1 wherein said radiative antenna element and reference ground element are mounted in a support tray and enclosed with a cover.

13. The antenna assembly of claim 12, wherein said cover includes raised portions to encourage ordered placement of tagged items at specific locations on top of the cover.

14. The antenna assembly according to claim 1 further including a second planar electrically conductive area of predetermined shape and dimension forming a second radiative antenna element on a second planar laminate, such that the second radiative antenna is disposed on a second plane that is different from the plane of the radiative antenna element; and a second planar electrically conductive area of predetermined shape and dimension forming a second reference ground element on the second planar laminate, such that the second reference ground element is on the second plane, and wherein there is no substantial overlap between the second radiative antenna element and the second reference ground element.

15. The antenna assembly of claim 1, wherein a portion of the radiative antenna element extends into a recess in the reference ground element.

16. The antenna assembly of claim 1, wherein the first planar electrically conductive floating ground element comprises a metal shelf upon which an array of antenna assemblies is placed.

17. A method of making an antenna assembly comprising the steps of:

providing a planar laminate;

forming a planar electrically conductive area of predetermined shape and dimension into a radiative antenna element on the planar laminate, and forming another planar electrically conductive area of predetermined shape and dimension into a reference ground element that is substantially smaller than the radiative antenna element on the planar laminate, such that the radiative antenna element and the reference ground element are coplanar, and wherein there is no substantial overlap between the radiative antenna element and the reference ground element;

providing a first planar electrically conductive floating ground element that is oriented parallel to the radiative antenna element and the reference ground element, that is separated from the planar laminate by an air-filled space, and that is electrically connected directly to the radiative antenna element;

providing a second planar electrically conductive floating ground element on the planar laminate, wherein the second floating ground element is substantially smaller than the radiative antenna element and is coplanar with the radiative antenna element and the reference ground element; and attaching a connection element that electrically connects each of the radiative antenna element and the reference ground element.

18. The method according to claim 17 wherein the steps of forming occur at the same time, and wherein the radiative antenna element and the reference ground element are formed on a same side of the planar laminate.

19. The method according to claim 18 wherein the steps of forming include one of depositing a patterned conductor that is shaped as the radiative antenna element and the reference ground element and etching deposited conductive material to obtain the radiative antenna element and the reference ground element.

20. The method according to claim 18 wherein the steps of forming form a plurality of radiative antenna elements and a plurality of reference ground elements on the planar laminate.

21. The method according to claim 20 wherein the step of providing a first planar electrically conductive floating ground element comprises attaching the first floating ground element to the planar laminate using a non-conductive support such that the first floating ground element is not electrically connected to said plurality of radiative antenna elements and is not electrically connected to said plurality of reference ground elements.

22. The antenna assembly of claim 21, wherein the radiative antenna elements and the second floating ground element are formed on the same side of the planar laminate.

23. The antenna assembly of claim 21, wherein the radiative antenna elements and the second floating ground element are formed on opposite sides of the planar laminate.

24. The method according to claim 17, wherein the step of forming the radiative antenna element and the reference ground element results in a portion of the radiative antenna element to extending into a recess formed in the reference ground element.

25. The method according to claim 17, wherein the first planar electrically conductive floating ground element comprises a metal shelf upon which an array of antenna assemblies is placed.

* * * * *